US006598766B1

(12) United States Patent
Brugner

(10) Patent No.: US 6,598,766 B1
(45) Date of Patent: Jul. 29, 2003

(54) VENTILATION DEVICE FOR A PISTON FOR A CARTRIDGE

(75) Inventor: Nikolaus Brugner, Ziemetshausen (DE)

(73) Assignee: Sulzer Chemtech AG, Winterthur (CH)

( * ) Notice: Subject to any disclaimer, the term of this patent is extended or adjusted under 35 U.S.C. 154(b) by 4 days.

(21) Appl. No.: 10/048,282

(22) PCT Filed: Mar. 21, 2001

(86) PCT No.: PCT/EP01/03221

§ 371 (c)(1),
(2), (4) Date: Jan. 28, 2002

(87) PCT Pub. No.: WO01/94028

PCT Pub. Date: Dec. 13, 2001

(30) Foreign Application Priority Data

Jun. 9, 2000 (DE) ..... 200 10 417 U

(51) Int. Cl.[7] ..... B65D 88/54
(52) U.S. Cl. ..... 222/326; 222/386; 222/387
(58) Field of Search ..... 222/326, 327, 222/325, 386, 387, 386.5, 481.5

(56) References Cited

U.S. PATENT DOCUMENTS 4,452,370 A * 6/1984 Langensiepen et al. ..... 222/327
4,671,432 A * 6/1987 Benecke et al. ..... 222/386
4,792,065 A * 12/1988 Soehnlein et al. ..... 222/387
4,854,485 A * 8/1989 Collins ..... 222/386
4,951,848 A 8/1990 Keller
5,000,355 A * 3/1991 Pritchard ..... 222/256
5,042,695 A * 8/1991 Battegazzore ..... 222/259
5,176,291 A * 1/1993 Fillmore et al. ..... 222/1
5,178,305 A 1/1993 Keller
5,238,003 A 8/1993 Baidwan et al.
5,316,186 A 5/1994 Prestele
6,494,348 B2 * 12/2002 Prestele ..... 222/326

FOREIGN PATENT DOCUMENTS

FR 2626248 A1 7/1989
GB 1475430 6/1977

* cited by examiner

*Primary Examiner*—Ehud Gartenberg
*Assistant Examiner*—Frederick C. Nicolas
(74) *Attorney, Agent, or Firm*—Martin Fleit; Paul D. Bianco; Fleit Kain Gibbons Gutman & Bongini P.L.

(57) ABSTRACT

The invention relates to a ventilation device for a piston for a cartridge. The ventilation device includes a first piston part which rests sealingly against the cartridge wall and a second piston part, which forms a valve with the first piston part. The valve opens when a pressure is exerted on the rear side of the piston so that the air is trapped between the filling composition and the piston can escape. According to the invention, a filter section is provided in front of the valve, between the two piston parts, as seen from the flow path of the air through the valve. This filter section has at least one narrow channel which forms a penetration barrier for the filling mass and ensures that the valve remains dry and free of dirt.

14 Claims, 3 Drawing Sheets

VENTILATION DEVICE FOR A PISTON FOR A CARTRIDGE

FIELD OF THE INVENTION

The innovation pertains to a ventilation device for a piston for a cartridge.

BACKGROUND OF THE INVENTION

According to DE GM 298 00 594, a micropore filter is inserted into a pocket formed in the piston. By means of this micropore filter, the air trapped between the filling mass and the piston can escape when the piston is inserted into the cartridge. Furthermore, this micropore filter is to prevent emission of the filling mass. With the bearing of the cartridges, components of certain filling masses exhibit a creeping, oil-like behavior. These components penetrate the micropore filter, which leads to leakage.

DE GM 295 06 800 shows another ventilation device. Here, the ventilation is performed by means of a plurality of valve plugs mounted around a divided circle of the piston cover, and these plugs are lifted from valve cones when the piston is pressed into the cartridge, thus enabling the outlet of air. However, this ventilation device can only be manufactured with tight production tolerances. Another disadvantage can be seen in that parts of the filling mass can advance up to the valves, which are then contaminated, so that their sealing function is adversely affected.

Starting with this ventilation device, the task is to configure this device such that the valve remains dry and free of dirt. Creeping, oil-like components of the filling masses should be prevented from leaking from the valve.

Summary of the Invention

The invention relates to a ventilation device for a piston for a cartridge, comprising a first piston part which rests sealingly against the cartridge wall and a second piston part, which forms a valve together with the first piston part. Said valve opens when a pressure is exerted on the rear side of the piston so that the air is trapped between the filling composition and the piston can escape. According to the invention, a filter section is provided in front of the valve, between the two piston parts, as seen from the flow path of the air through the valve. This filter section has at least one narrow channel which forms a penetration barrier for the filling mass and ensures that the valve remains dry and free of dirt.

BRIEF DESCRIPTION OF THE DRAWINGS

Embodiments are described in more detail in the following with reference to the drawings. Shown are.

DETAILED DESCRIPTION OF THE INVENTION

Figure 1:
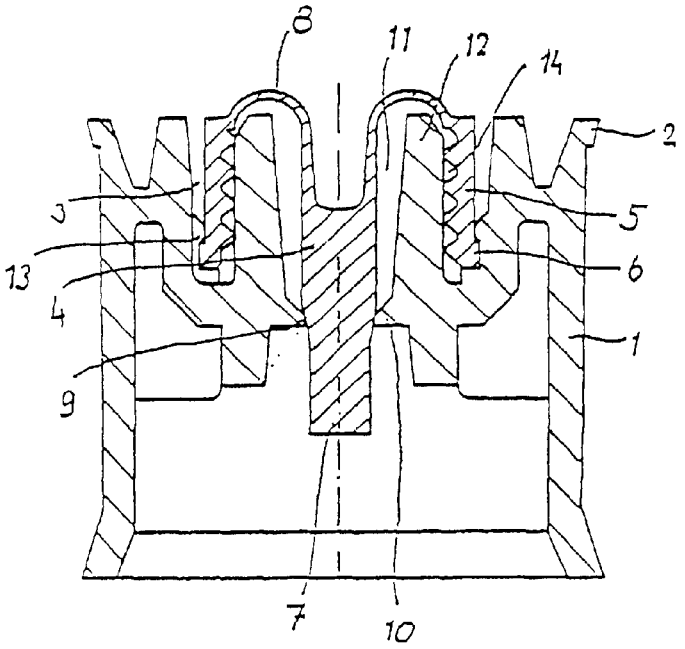
FIG. 1: a section through a first embodiment of a piston.

The piston from FIG. 1 has a first piston part 1 with a sealing lip 2 that contacts the cartridge wall. This piston part

1 has a circular cylindrical recess 3. The piston further has a second piston part 4. This piston part 4 includes a circular cylindrical wall part 5 that engages with the first piston part 1 at the base of the recess 3. The engagement connection is designated 6. The circular cylindrical wall part 5 transitions along an arc into a valve plug 7. This valve plug 7 penetrates a cylindrical hole 11 in the first piston part 1 and has a valve face 9 that contacts the valve lip 10 of the first piston part 1. The arc-like transition region 8 crosses over the cylindrical wall 12 between the hole 11 and the recess 3.

The engagement 6 is interrupted by a small air channel 13. A filter section 14 is formed between the outer side of the wall 12 and the inner side of the circular cylindrical wall part 5. This filter section 14 comprises narrow channels in the inner wall of the wall part 5.

The arc-like transition region 8 ensures that the valve plug 7 is pressed against the rear side of the piston.

If the piston is inserted into a cartridge by a tool, then the valve plug 7 is moved upwards, whereby the valve formed by the parts 9, 10 is opened. The air trapped between the filling mass and the piston escapes through the recess 3, the channel 13, and the filter section 14, and is emitted by the valve 9, 10. If the piston is pushed against the filling mass, then this mass reaches completely throughout the channel 13, but not into the filter section 14. In this way, filling mass is prevented from reaching the valve 9, 10. For filling masses that secrete creeping, oil-like components, it is completely possible for these components to penetrate the filter section 14, but their emission is prevented by the valve 9, 10.

Figure 2:
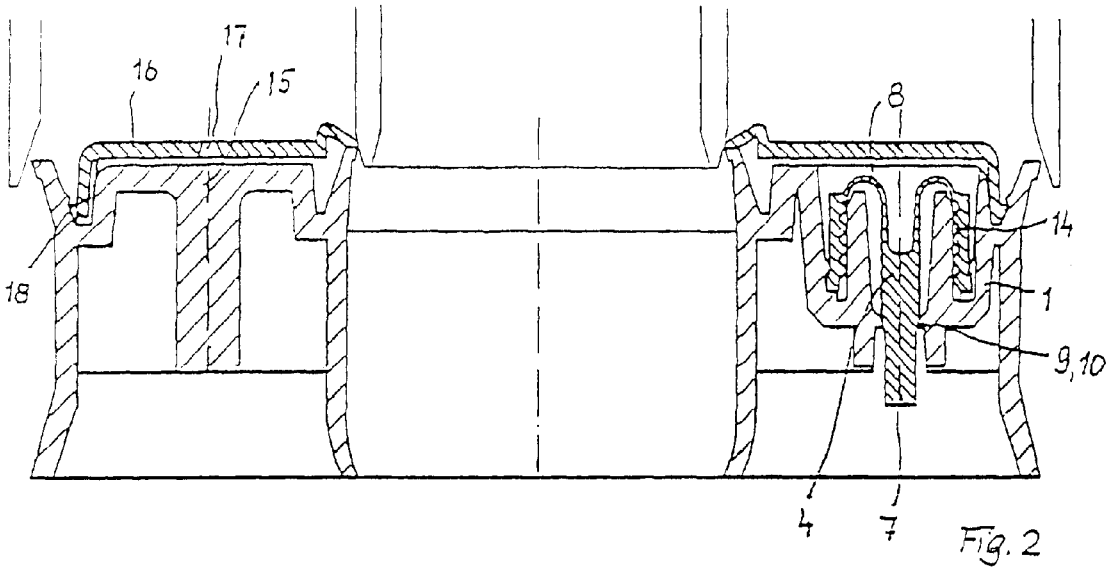
FIG. 2: a section through an annular piston with the ventilation device from FIG. 1.

According to FIG. 2, the filter valve from FIG. 1 is integrated into an annular piston 15. This annular piston is covered by a cover plate 16 that is made out of a plastic material that is not attacked by the filling masses. This cover plate has at least one ventilation hole 17 and/or one ventilation channel 18, by means of which the air trapped between the piston and the filling mass can escape to the filter valve.

Figure 4:
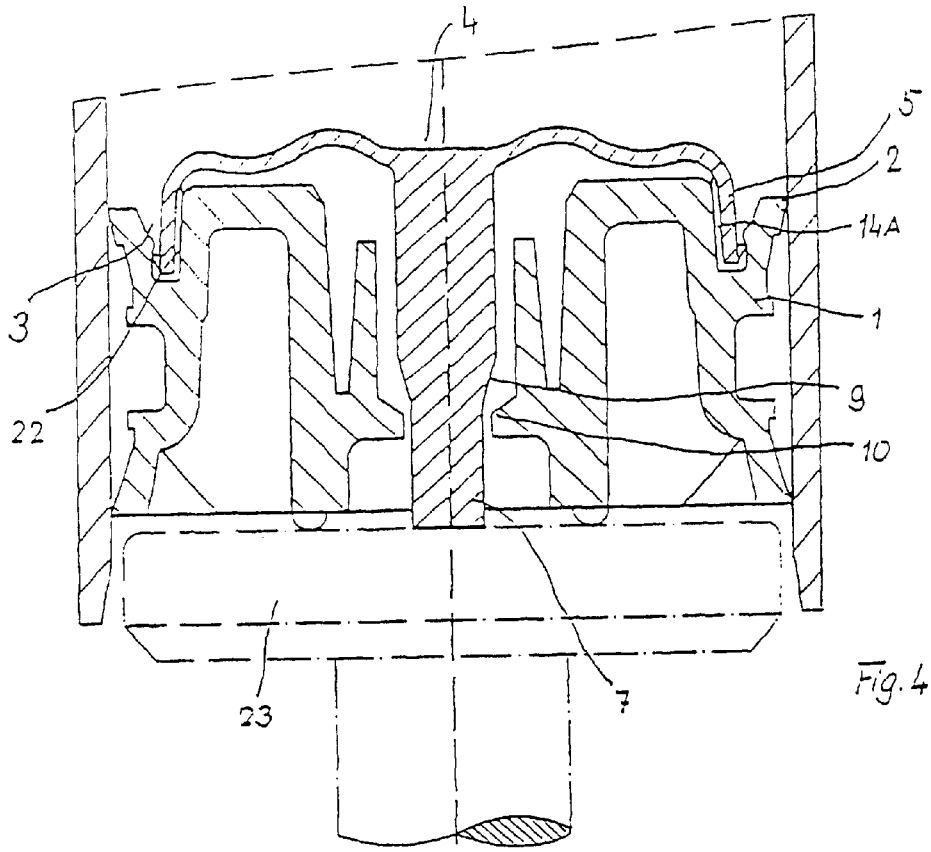
FIG. 4: a section through the piston of FIG. 3 for an opened ventilation device.
Figure 3:
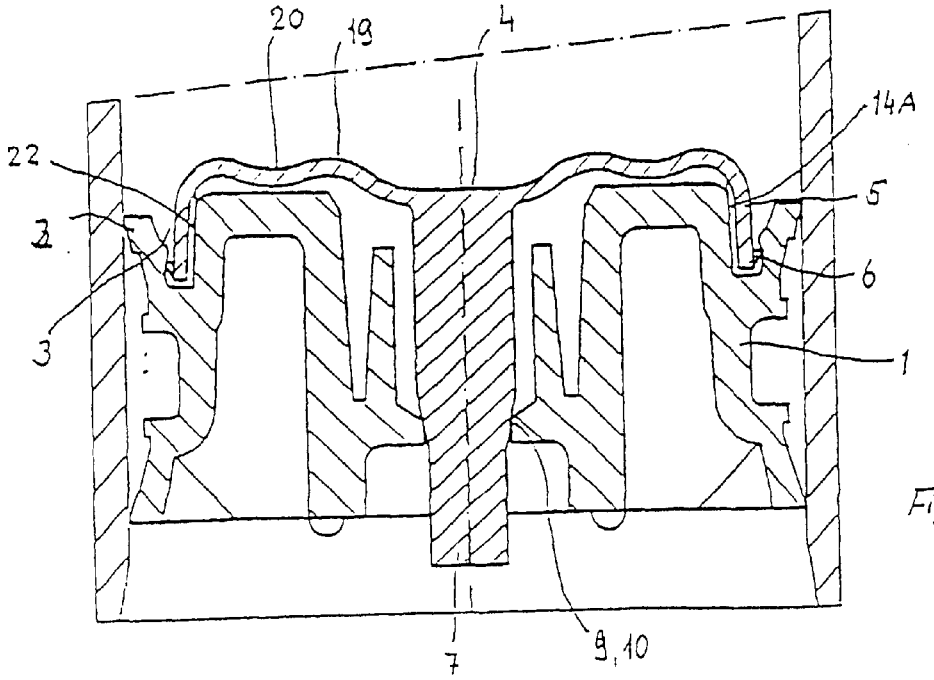
FIG. 3: a section through a second embodiment of a piston for a closed ventilation device.

The embodiment from FIGS. 3 and 4 is distinguished from that in FIG. 1 primarily due to the fact that instead of the arc-like transition region 8, now there is a disk-like transition region 19. This preferably has concentric undulations 20. This disk-like transition region 19 exhibits a spring function that ensures that the valve face 9 is pressed against the valve lip 10. While the filter section 14 is formed by a helical channel in the embodiment from FIG. 1, the filter section 14A from FIGS. 3 and 4 is formed by axial grooves 22 that are formed in the second piston part 4. Instead of axial grooves, there can also be helical grooves.

FIG. 4 illustrates how a piston setting tool 23 acts against the valve plug 7 and thus opens the valve 9, 10.

Figure 5:
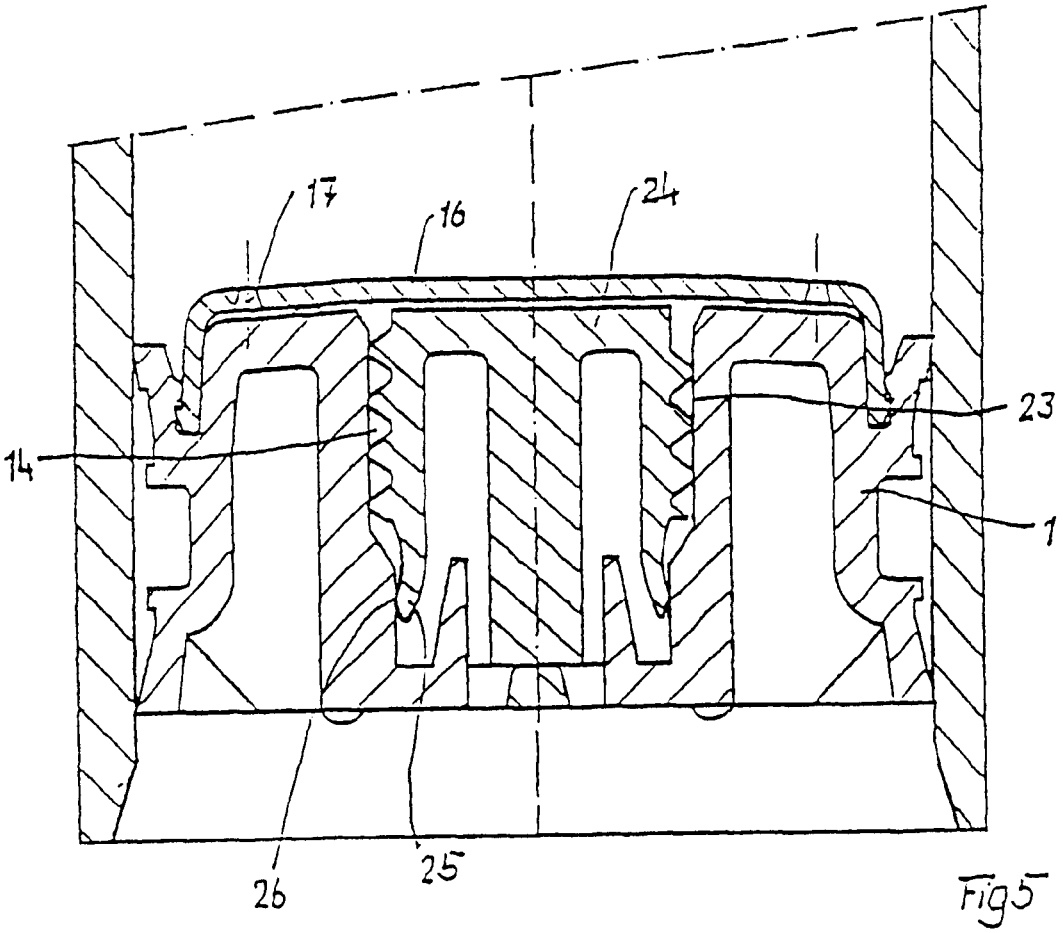
FIG. 5: a section through a third embodiment of a piston.

For the embodiment from FIG. 5, there is, in turn, a cover plate 16 with ventilation holes 17. The first piston part 1 has a central hole 23, in which the second piston part 24 is inserted. A filter section 14 is formed between the hole 23 and the second piston part 24. A sealing lip 25, which contacts the tapering region 26 of the hole 23, is attached to the lower end of the piston part 24.

The filter section 14 can be formed by circular channels, which have interruptions for passage of air between channels. They can also be formed by longitudinal ribs according to FIG. 3. Preferably, the filter section 14 is formed by helical threads. The channels of the filter section are only a few tenths of a millimeter thick, so that viscous filling masses cannot penetrate through these channels.

What is claimed is:

1. A piston for a cartridge having a wall, the piston fillable with a filling mass and comprising:

a first piston part resting sealingly against the cartridge wall;

a second piston part;

a valve formed by the first and second piston parts, said valve opening when a pressure is exerted on a rear side of the piston so that air trapped between the filling mass and the piston can escape, wherein a filter section is provided in front of the valve between the first and second piston parts with respect to a flow path of air through the valve, and the filter section has at least one narrow channel forming a penetration barrier for the filling mass.

2. Piston according to claim 1, wherein the valve and the filter section are arranged concentric to each other.

3. Piston according to claim 1, wherein an outer region of the second piston part engages with the first piston part, the engagement is interrupted by an air channel, and the filter section connects to the engagement.

4. Piston according to claim 3, wherein the second piston part features a valve face that tapers towards the rear side of the piston and is pressed by the second piston part against a valve lip on the first piston part when the second piston part is engaged.

5. Piston according to claim 4, wherein the first piston part features a circular cylindrical recess, in which a circular cylindrical wall part of the second piston part engages, and the second piston part transitions into a valve plug with the valve face.

6. Piston according to claim 5, wherein the filter section is formed between one wall of the recess and one wall of the wall part.

7. Piston according to claim 5, wherein the circular cylindrical wall part has a transition region with an arc shape and the transition region presses the valve plug in the direction of the rear side of the piston.

8. Piston according to claim 5, wherein the circular cylindrical wall part has a transition region with a disk shape and the transition region is configured with concentric undulations and presses the valve plug in the direction of the rear side of the piston.

9. Piston according to claim 1, wherein the first piston part has a circular cylindrical hole in which the second piston part is inserted and the second piston part has a valve lip at the rear side of the piston, the valve lip contacting a tapering region of the hole.

10. Piston according to claim 1, wherein the filter section is formed by circular channels with interruptions.

11. Piston according to claim 10, wherein the channels are less than a millimeter thick.

12. Piston according to claim 1, wherein the filter section is formed by longitudinal ribs.

13. Piston according to claim 1, wherein the filter section is formed by threads.

14. Piston according to claim 1, wherein the first piston part has an upper side facing the filling mass and the upper side is covered by a cover plate having holes.

* * * * *